United States Patent [19]

Munoz

[11] Patent Number: 4,948,003

[45] Date of Patent: Aug. 14, 1990

[54] CONTAINER AND CLOSURE WITH INTERNAL TAMPER INDICATION

[75] Inventor: Daniel R. Munoz, Vernon Hills, Ill.

[73] Assignee: Kraft, Inc., Glenview, Ill.

[21] Appl. No.: 302,474

[22] Filed: Jan. 26, 1989

[51] Int. Cl.[5] ..... B65D 55/02

[52] U.S. Cl. ..... 215/237; 215/224; 215/246; 215/253

[58] Field of Search ..... 215/237, 253, 246, 213, 215/298, 305

[56] References Cited

U.S. PATENT DOCUMENTS

| | | | |
|---|---|---|---|
| 3,758,000 | 9/1973 | Mack | 215/224 X |
| 3,817,416 | 6/1974 | Costa | 215/213 |
| 3,860,152 | 1/1975 | Marti | 215/224 X |
| 4,371,089 | 2/1983 | Barendregt | 215/253 X |
| 4,782,964 | 11/1988 | Poore et al. | 215/237 X |
| 4,795,044 | 1/1989 | Beck | 215/237 |
| 4,817,807 | 4/1989 | Hummer | 215/253 |

FOREIGN PATENT DOCUMENTS

| | | | |
|---|---|---|---|
| 2755136 | 6/1978 | Fed. Rep. of Germany | 215/237 |
| 2451326 | 11/1980 | France | 215/237 |
| 2524427 | 10/1983 | France | 215/253 |
| 2022064 | 12/1979 | United Kingdom | 215/246 |

*Primary Examiner*—Stephen Marcus
*Assistant Examiner*—Christine A. Peterson
*Attorney, Agent, or Firm*—Fitch, Even, Tabin & Flannery

[57] ABSTRACT

Disclosed is a tamper-evident closure for a container having a finish opening and including a cap member hingedly connecting to a base member. The base member is threadingly engaged with the bottle finish, and includes an upwardly extending pour spout. A sealing disk is installed in the interior of the pour spout and is secured thereto with a rupturable ring. A pull tab is attached to the sealing disk and, when pulled, causes removal of the sealing disk, threby allowing access to the interior of the bottle container. The cap includes an interior wall which engages the pour spout with a snap fit, providing a liquid-tight and airtight closure therefor.

1 Claim, 2 Drawing Sheets

CONTAINER AND CLOSURE WITH INTERNAL TAMPER INDICATION

BACKGROUND OF THE INVENTION

This invention relates to a plastic closure which is made inexpensively with injection molding equipment, and more particularly, to closures having a tamper-evident seal or tear-off portion which is removed the first time the closure is opened, to provide a tamper-evident feature for the container.

The present invention is particularly useful for containers of fluid products which are dispensed by pouring. Users of such containers have found it convenient to have a pour spout associated with the container to prevent dripping or unintentional spilling of the contents during pouring. With the continued emphasis on tamper indication and product safety, it is becoming increasingly important that such containers be provided with an indication of tampering, not only with respect to the liquid contents thereof, but also with respect to the pour spout which, by reason of the product contact inherent in its operation, plays an important role in consumer safety and satisfaction.

Occasionally, closures, and particularly those closures formed by injection molding, have been provided with a tear strip which must be removed in order to allow access to the container contents. Closures having these tear strip arrangements often require more intricate, less desirable mold designs and special application machinery to mate the closures with bottles and the like containers having conventional threaded finishes.

Further, there has been considerable interest in assuring an easy and predictable removal of the tear strip tamper indicator from the closure. Costly molding and post-forming tooling have been necessary in some applications, to provide a closure with deformable elements having the desired rupture characteristics. However, as those skilled in the art will readily appreciate, significant economies of operation can be achieved if the closure is molded or otherwise formed with as few pieces as possible, and the greatest cost advantages are often achieved with a closure which can be molded as an integral component.

Consumers familiar with containers having pour spouts for fluid products, especially foods such as ketchup, salad dressing or the like products which congeal upon exposure to open air, will appreciate that the pour spout must be totally enclosed in an air-free environment when not in use. Squeeze bottles or the like having a snorkel-like pouring nozzle have been provided with end caps which fit over the free end of the nozzle and which are secured to the base of the nozzle with plastic banding integrally formed therewith. However, considerable care must be exercised in aligning the end cap with the nozzle. Also, the interconnecting band or strap is fragile and susceptible to tearing, with a potential loss of the end cap closure.

Other nozzles, such as those used with mustard containers, have closure arrangements located internal to the nozzle at points remote from the pouring tip thereof. However, after a dispensing operation is completed, the tip of the nozzle remains filled with the product, being trapped in the nozzle, above the closure elements. Over time, upon exposure to the outside air, the product trapped in the tip of the nozzle will spoil, congeal or otherwise present an unsatisfactory condition to the consumer. Accordingly, it is desirable to eliminate such trapping of product in the spout and to provide a total enclosure of the spout, preventing its contact with the outside air.

SUMMARY OF THE INVENTION

Accordingly, it is a general object of the present invention to provide a new and improved closure for a container, the closure having an internal tearable portion providing tamper indication.

Another object of the present invention is to provide a closure having a spout and a tear portion sealing the spout, integrally formed therewith, which must be removed in order to attain access to the product disposed within the container.

A further object according to the present invention is to provide a closure having a cap which is movable between open and closed positions and which provides an airtight seal for the pour spout when in the closed position.

An additional object according to the present invention is to provide a pull tab for a tear-away seal positioned internal to a spout, adjacent a free end thereof.

These and other objects and advantages of the present invention, which will become apparent from the following description taken in connection with the accompanying drawings, are provided in a tamper-evident cap for a container having a finish opening comprising:

a base member including means for securement to the bottle finish, means for forming a liquid-tight seal to the bottle finish, spout means for forming an upwardly extending spout having an internal bore through which contents of the container are discharged;

a cap member including an end wall and an annular skirt depending from an outer periphery thereof, a cylindrical internal collar depending from the end wall and disposed within the annular skirt so as to be at least partially enclosed thereby, and said collar having an internal recess dimensioned to receive at least a portion of said spout so as to close the internal bore thereof;

hinge means for hingedly joining the cap and base members with the cap hingedly mounted for movement between an open position remote from said spout and a closed position with said internal collar engaging said spout; and said internal collar and said spout having releasable locking means which are separated upon opening of the cap.

DETAILED DESCRIPTION OF THE PREFERRED EMBODIMENT

Figure 1:
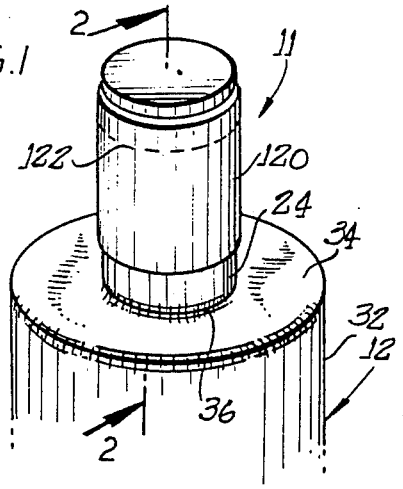
FIG. 1 is a perspective view of a container and closure constructed in accordance with one embodiment of the invention.

As shown in the drawings for purposes of illustration, the invention is embodied in a container assembly 10 having a closure 11 which is press-fitted and snap-fitted on the bottle container 12, and in sealing engagement to cover the open mouth 14 of the container.

Figure 2:
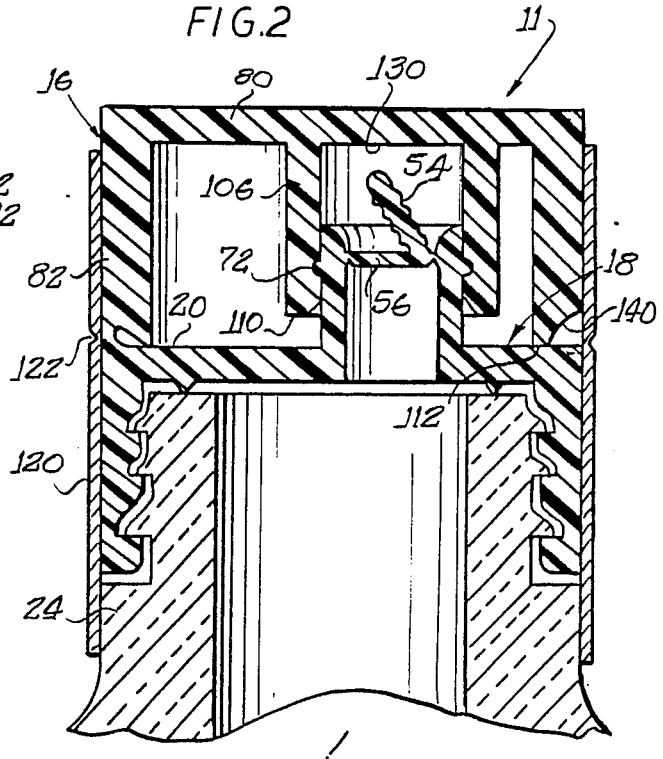
FIG. 2 is a fragmentary, cross-sectional elevational view of the container and closure of FIG. 1, taken along the line 2—2.
Figure 3:
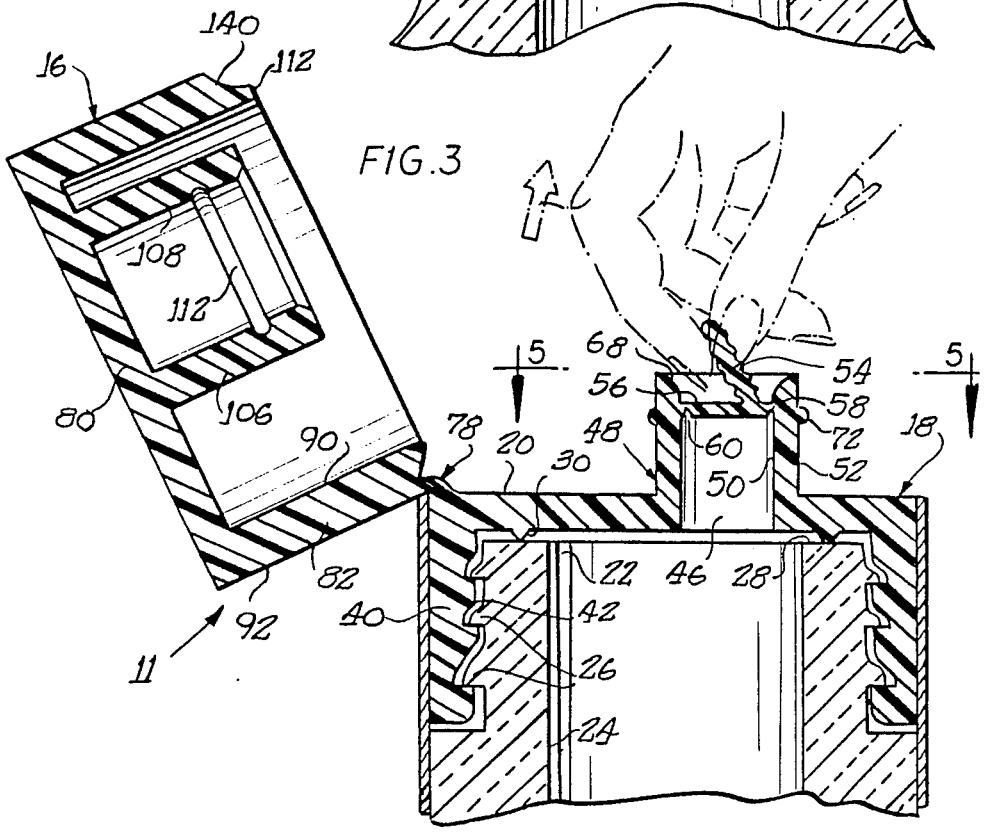
FIG. 3 is a fragmentary elevational view similar to that of FIG. 2 but showing the cap in an opened position to provide access to the tear-away seal internal to the spout.

Referring to FIGS. 2 and 3, the closure 11 includes a cap 16 hingedly connected to a base 18. The base 18 includes an upper wall 20 spanning the open end 22 of a conventional bottle finish 24. The bottle finish 24 includes a series of recessed, external threads 26 and an upper, annular free edge 28.

The upper wall 20 of the cap is provided with a downwardly extending sealing ring 30 which is resiliently deformable so as to form a fluid-tight seal with annular end 28 of the bottle finish. Referring briefly to FIG. 1, the bottle 12 has a major body portion 32 and an upper end wall 34. The finish 24 has a diametrical size considerably smaller than that of body portion 32, and is joined to the interior portions of upper wall 34 by an annular joint 36. As will be seen herein, the present invention is also applicable for use with bottles and the like containers having diametral dimensions corresponding to those of the bottle finish, so as to eliminate top wall 34, for example.

Base member 18 has an annular sidewall 40 downwardly depending from the upper wall 20. Sidewall 40 has internal threads 42 for mating engagement with the threads 26 of the bottle finish. Although not necessary for the practice of the present invention, it is generally desirable to provide a locking engagement between the closure 11 and the bottle finish 24 so as to prevent its unthreading, once mated therewith. There are a number of such locking arrangements in commercial use today, and accordingly a detailed description thereof will not be given here. For example, the bottle finish can be provided with a ring of outwardly extending sawtooth structures which are slanted in a direction opposite to that required for rotational removal of the fixture. Mating teeth at the bottom of the closure interlock therewith to prevent unscrewing of the closure. In these arrangements, the lower and upper portions of the closure are usually separated by a plurality of frangible bridges. As will be seen, the present invention is readily usable with conventional threaded finishes, and can be used with closures thereafter which are either threadingly engaged with the bottle finishes, or which are telescoped thereover to provide an initial closure of the bottle.

Referring once again to FIGS. 2 and 3, the upper wall 20 of base member 18 has an opening 46 therein, communicating with the interior of the bottle finish and the bottle. A pour spout, generally indicated at 48, is integrally formed with upper wall 20 at opening 46. The pour spout 48 is generally cylindrical, having an internal sidewall 50 forming a passageway for discharge of the bottle contents, and an external sidewall 52 which is blended with the upper surface of upper wall 20. If desired, the pour spout can have configurations other than that of a right circular cylinder.

The internal passageway of pour spout 48 is blocked at its upper end by a tear-away sealing member or disk 56. The sealing disk 56, disposed within the interior of pour spout 48, is joined to the inner wall 50 thereof by a frangible ring 58. In the preferred embodiment, frangible ring 58 is formed with an annular V-shaped notch 60 extending into the outer periphery of sealing disk 56 so as to reduce the thickness thereof. The present invention also contemplates alternative arrangements for weakening the juncture of sealing disk 56 with pour spout 48. For example, the V-shaped ring 60 can be replaced with a series of spaced-apart notches having a density sufficient to weaken the juncture of sealing disk 56 with pour spout 48, thereby allowing its ready removal.

Figure 4:
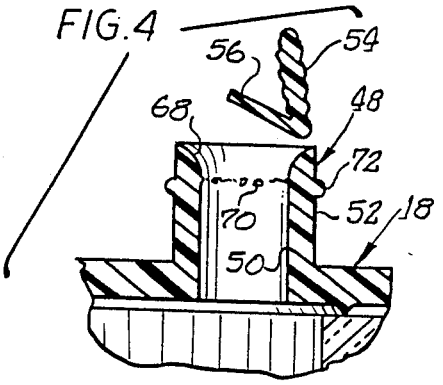
FIG. 4 is a fragmentary cross-sectional view showing removal of the tear-away seal from the spout.
Figure 5:
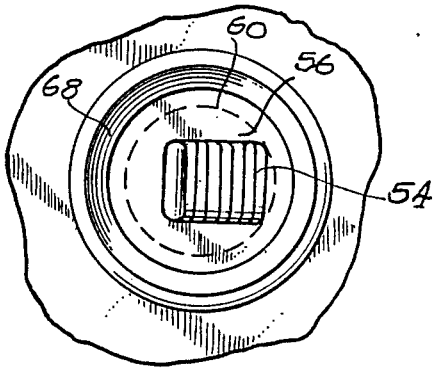
FIG. 5 is a top plan view of the spout of FIG. 3.

A pull tab 54 is integrally formed with sealing disk 56, and is preferably joined at a portion of the outer periphery of the disk, as is clearly shown in FIGS. 4 and 5. The outer, opposed major surfaces of pull tab 64 are serrated or otherwise roughened to provide an enhanced frictional engagement when grasped by a user's fingers, as shown in phantom in FIG. 1. As a further feature of the present invention, the sealing disk 56 and hence the point of attachment of the disk with the first end of pull tab 64, is recessed a precise amount to allow a user to lever the pull tab so as to augment the upward pulling thereof. As indicated in phantom in FIG. 3, a user can insert the tip of a finger between one side of the pull tab and the free end of inner sidewall 50, which is rounded at 68 to prevent discomfort to the user's finger, and to enhance the drip-proof operation of the pour spout.

As indicated in FIG. 4, a ring 70 of residue from the frangible ring 60 may be left adhering to the inner sidewall 50 of pour spout 48. However if desired, those skilled in the art can readily provide a weakening groove having a configuration which leaves very little, if any, residue on inner sidewall 50, with the entire frangible ring remaining on the outer periphery of the sealing disk 56.

Referring to FIGS. 2–4, an outwardly protruding snap-on sealing ring 72 is formed on outer sidewall 52 of the pour spout. As mentioned above, it is important to provide an airtight seal for the pour spout then the container is used to hold products which congeal or otherwise undergo an unsatisfactory transformation when exposed to the open air. For example, if the container 12 is used for packaging catsup or mustard or the like food product, any residue of that product clinging to the inner sidewall 50 may congeal or thicken so as to prevent the desired pouring characteristics of the closure. As will be seen shortly herein, the present invention provides an airtight seal completely enclosing the open end of the pour spout 48. In addition, the sealing of the pour spout 48 provided by the present invention maintains a liquid-tight seal for the pour spout, preventing leakage or spills.

Figure 6:
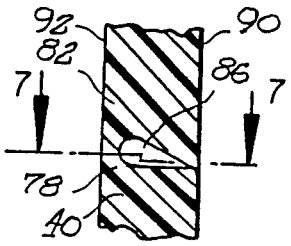
FIG. 6 is a fragmentary view, taken on an enlarged scale, showing the hinge portion of the cap of FIG. 2.
Figure 7:
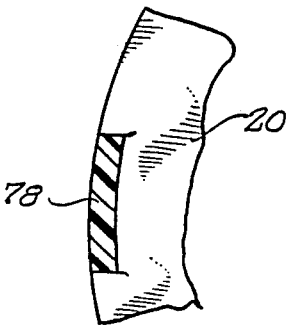
FIG. 7 is a fragmentary cross-sectional view taken along the line 7—7 of FIG. 6.

As mentioned above, it is important for many consumers that the closure of the pour spout be made as simple and foolproof in operation as is possible. Accordingly, the preferred embodiment of the present invention provides a cap 16 which is integrally formed with the base member 8, and which is joined thereto through an arcuate hinge member 78 which is shown on an enlarged scale in FIGS. 6 and 7. Although not necessary, it is preferred to to have the hinge recessed within the outer surface of the cap. The cap 16 includes an upper wall 80 and a generally annular sidewall 82 downwardly depending from the outer periphery thereof. As indicated in FIG. 7 the arcuate hinge portion 78 is relatively small compared to the peripheral dimensions of the sidewall 82 and finish sidewall 40. Referring to FIG. 6, an undercut 86, generally teardrop-shaped in cross-sectional configuration, extends from an interior sidewall 90 in an outward direction, toward the outer surface 92 of sidewall 82. The undercut 86 increases the flexibility of hinge 78, thus providing significant cost savings, by allowing the use of a single plastic material throughout the construction of closure 11.

Figure 8:
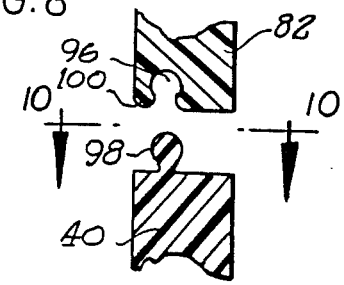
FIG. 8 is a cross-sectional elevational view of an alternative hinge assembly for mounting the cap to the closure base.
Figure 9:
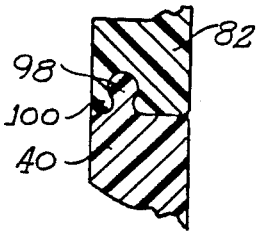
FIG. 9 is a cross-sectional elevational view of the articulated hinge of FIG. 8 shown in a fully assembled condition.
Figure 10:
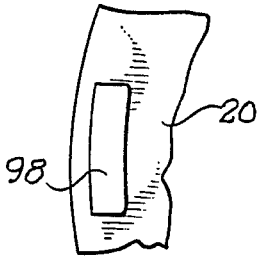
FIG. 10 is a fragmentary, top plan view of the lower portion of the articulated hinge of FIG. 8 taken along the line 10—10.

If, however, the plastic material of choice is so stiff or rigid so as to fail to provide satisfactory compliance, even with undercut 86, an alternative, articulated hinge construction, such as that illustrated in FIGS. 8–10, can be used. Turning now to FIG. 8, cap 16 is separably formed from the base member 18. FIG. 8 illustrates a lower portion of cap sidewall 82, having a keyhole slot 96 formed therein, adjacent the lower free end of the sidewall 82. An opposing portion of the finish sidewall 40, has an upstanding bead 98 with a rounded, enlarged free end for a snap fit into the keyhole 96, as illustrated in FIG. 9. FIG. 10 shows the relatively short length of the upstanding bead 98. The outer corner 100 of cap sidewall 82 is rounded so as to allow tilting of the cap away from the base member, in a manner similar to that illustrated in FIG. 3. The articulated hinge of FIGS. 8 and 9 allows a full opening of the cap without a risk of disengagement from the base member.

Returning to FIGS. 2 and 3, an internal cylindrical collar 106 depends downwardly from an inside surface of upper cap wall 80. The internal collar 106 is generally cylindrical and is dimensioned to telescopically receive the pour spout 48 therein. The lower free end of internal collar 106 is rounded at 108 to facilitate the initial insertion of the pour spout therein as cap 16 is swung about its hinge point. Preferably, the material used to form closure 11 is chosen so as to provide a resilien't deflection in internal collar 106, further facilitating the trouble-free insertion of pour spout 48 therein.

An outwardly extending annular depression 112 is formed in the interior wall of collar 106. As indicated in FIG. 3, the annular depression 112 is spaced from the free end of collar 106. The annular recess 112 provides a releasable snaplock engagement with the annular bead 72 of pour spout 48, being preferably configured for a close-fit engagement therewith so as to provide an intimate void-free seal, as indicated in the cross-sectional view of FIG. 2. The seal formed between the inner sidewall of collar 106 and the outer surface of spout 48 is also liquid-tight and airtight, to further protect the contents of container 12 against degradation.

As illustrated in FIG. 2, the collar 106 is dimensioned slightly shorter than the cap sidewall 82, with the free end 110 of collar 106 being spaced above the upper surface of the base member upper wall 20. Thus, the closing travel of cap 16 is stopped when the lower free end 112 thereof contacts the upper surface of upper wall 20. The inner collar 106 is thereby allowed to "float" while it seeks a full engagement with locking bead 72, thereby eliminating the need for a close tolerance manufacture of the internal portions of cap 16 and pour spout 48.

As can be seen in FIG. 2, the sealing disk 56 and the pull tab 64 are entirely enclosed within cap 16, so as to remain free from contamination, such as that which normally might occur during shipping and handling of the product. In the preferred embodiment, outer neck band 120 is either shrink-fit or adhesively secured to the outer surfaces of cap 16, base member 18, and finish 24. Neck band 120 provides additional tamper indication, as well as providing a sanitary seal for the closure 11. The neck band 120 is provided with a perforate ring 122 which must be broken to allow cap 16 to be swung to an open position. The breaking of neck band 120 provides a first indication of tampering. If desired, an indenting ring 140 can be provided at the lower end of the cap sidewall to allow the easy rupture of the neck band at the perforation ring 122.

Thereafter, assuming the neck band has been broken so as to allow access to closure 11, and the cap 16 has been swung to the open position of FIG. 3, the interior product-containing portions of closure 11 and most of the interior portions of pour spout 48 will remain protected by sealing disk 56. Attempts at unauthorized entry into the interior of container 12 will be occasioned by a rupturing of the frangible ring joining the sealing disk to the pour spout. Preferably, the frangible ring 58 joining the sealing disk to the pour spout is relatively fragile so that attempts at unauthorized entry will result in a rupture thereof, and thereby provide a readily visible indication of an entry or attempted entry into the container.

As discussed above, the residue 70 produced by the rupturing of ring 58 may, in some applications, be undesirable from the aspect of the pouring performance of the closure 11. However, experience has indicated that the residue 70 produces only relatively minor disruptions on the otherwise smooth internal surface 50 of the pour spout and does not significantly impair pouring performance of the closure. Accordingly, when allowed to remain, the ring of residue 70 provides a further visual indication that entry to the interior of the container has taken place. If desired, the frangible ring 58 can be constructed such that it is stretched during pulling, thereby preventing a seating of the sealing disk if attempts are made to reinstall it in the pour spout 48.

Various alternatives to the above-described embodiment can be made. For example, referring to FIG. 2, the free end of pull tab 64 can be joined by a band or strip of material to the inside surface 130 of upper cap wall 20. The band can conveniently be integrally molded with the pull tab and upper cap wall. Upon an initial opening of cap 16 by swinging the cap to the position of FIG. 3, the band connecting the pull tab to the upper cap wall causes a rupture of the frangible ring 58, thereby automatically opening the internal sealing disk 56. This latter, alternative arrangement provides a ready visible indication that the cap 16 has been swung to an open position. Although this latter, alternative arrangement sacrifices the integrity of closure 11, it provides an indication that less aggressive unauthorized attempts have been made to gain entry to the container contents. When this latter alternative is employed, the juncture of the pull tab with the upper cap wall can be weakened so as to be torn away by a consumer after an initial opening of the closure.

In yet a further alternative embodiment, one or more strands of easily stretched plastic material can be extended between the upper cap wall and the pull tab 64 or sealing disk 56. Such bands could be dimensioned so as to provide a tactile indication of a normal resistance upon an opening of cap 16.

If cap 16 is made of transparent or translucent material, stretching of these bands would provide a readily identifiable abnormal condition, indicating that the cap 16 has been swung to an open position. The indicator bands could be weakened at one end, at their point of juncture with the upper cap wall 180, so as to be separated therefrom upon cap opening. The second ends of the indicating bands could be joined to pull tab 64 or sealing disk 56, so as to be removed from the closure when the sealing disk is removed. The lack of an initial resistance to opening of cap 16, coupled with the readily visible deformation of the indicator bands, would provide an additional tamper indication.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A tamper-evident closure assembly for a container having a finish opening comprising:

a base member including means for securement to the bottle finish, means for forming a liquid-tight seal to the bottle finish, spout means for forming an upwardly extending spout having an outer surface and an internal bore through which contents of the container are discharged;

a cap member including an end wall and an annular skirt depending from an outer periphery thereof, a cylindrical internal collar depending from the end wall and disposed within the annual skirt so as to be at least partially enclosed thereby, and said collar having an internal recess dimensioned to receive at least a portion of said spout therein, with the collar in direct contact with the outer surface of the spout to close the spout internal bore without protruding therein;

hinge means for directly joining the cap to the base member with the cap hingedly mounted for movement between an open position remote from said spout and a closed position with said internal collar engaging said spout;

said internal collar and said spout having releasable locking means which are separated upon opening of the cap and which maintain the cap endwall spaced from said spout means when the cap closes the spout; and a frangible seal integrally formed with the pour spout and joined thereto through a frangible ring, and pull tab means integrally formed with the frangible seal to facilitate rupture of the frangible ring, thereby allowing removal of the seal from the spout.

* * * * *

UNITED STATES PATENT AND TRADEMARK OFFICE

CERTIFICATE OF CORRECTION

PATENT NO. : 4,948,003

DATED : August 14, 1990

INVENTOR(S) : Daniel R. Munoz

It is certified that error appears in the above-identified patent and that said Letters Patent is hereby corrected as shown below:

On the face of the patent, under the heading marked "Abstract", change "threby" to read the word --thereby--.

In Column 3, line 29, change "diametrical" to read the word --diametral--.

In Column 4, line 25, change "FIG. 1" to read --FIG. 3--.

In Column 4, line 47, change the word "then" to read the word --when--.

In Column 5, line 42, change "resilien't" to read the word --resilient-- (Take out apostrophe).

Signed and Sealed this

Twenty-first Day of January, 1992

*Attest:*

HARRY F. MANBECK, JR.

*Attesting Officer*

*Commissioner of Patents and Trademarks*